United States Patent [19]

Beckedorf

[11] Patent Number: 4,951,435

[45] Date of Patent: Aug. 28, 1990

[54] LOG BUILDING CONSTRUCTION

[76] Inventor: Lloyd Beckedorf, P.O. Box 26, Bragg Creek, Alberta, Canada, T0L 0K0

[21] Appl. No.: 297,851

[22] Filed: Jan. 17, 1989

[51] Int. Cl.[5] ..... E04B 1/10

[52] U.S. Cl. ..... 52/233

[58] Field of Search ..... 52/233

[56] References Cited

U.S. PATENT DOCUMENTS

| | | | |
|---|---|---|---|
| 4,147,000 | 4/1979 | Lewandoski | 52/233 |

FOREIGN PATENT DOCUMENTS

| | | | |
|---|---|---|---|
| 476660 | 9/1951 | Canada | 52/233 |
| 963227 | 2/1975 | Canada . | |
| 968921 | 6/1975 | Canada . | |
| 1010216 | 5/1977 | Canada . | |
| 1124481 | 6/1982 | Canada . | |
| 68058 | 7/1944 | Norway | 52/233 |

*Primary Examiner*—Carl D. Friedman

*Attorney, Agent, or Firm*—William R. Hinds; George H. Dunsmuir

[57] ABSTRACT

A relatively simple log for use in log buildings includes a first large, longitudinally extending, V-shaped groove in the top of the log, and a pair of smaller longitudinally extending, inverted V-shaped grooves in the bottom of the log on opposite sides of a plane through the longitudinal axis of the log and through the vertex of the top groove, the spacing between the second grooves being such that outward extensions of the sides of the top groove in one log would intersect the outer sides of the second grooves in a superjacent log resting on such one log. In a wall structure, loose insulation fills the top groove and denser sealing insulation fills the smaller, bottom grooves.

4 Claims, 1 Drawing Sheet

LOG BUILDING CONSTRUCTION

BACKGROUND OF THE INVENTION

This invention relates to a log for use in constructing a wall or log building, and to the wall constructed with a plurality of such logs.

Log buildings have been in existence since before Europeans arrived in North America. One of the major problems encountered when constructing buildings of logs involves the insulation and sealing of the area where logs meet. Logs are seldom completely rectilinear, and gaps between adjacent logs are common. One solution to the problem is to caulk both sides of the joints between logs. Somewhat more sophisticated joint structures are proposed in Canadian Patent Nos. 963,227, which issued to C. R. Fell et al on Feb. 25, 1975; 968,921, which issued to D. Bain on June 10, 1975; 1,010,216, which issued to T. B. Hisey on May 17, 1977 and 1,124,481, which issued to R. L. Collister, Jr. on June 1, 1982, and U.S. Pat. No. 4,147,000, which issued to R. L. Lewandowski on Apr. 3, 1979.

While recent proposals provide effective seals between logs, most such proposals rely on somewhat complicated, longitudinally extending tongues and grooves. The forming of complicated joint profiles is both expensive and time consuming.

The object of the present invention is to deal with the above defined problems by providing a relatively simple log for constructing a wall, and a wall structure incorporating a plurality of such logs.

BRIEF SUMMARY OF THE INVENTION

According to one aspect, the invention relates to a log for use in constructing a wall by stacking similar logs on top of each other comprising a first longitudinally extending, substantially V-shaped groove in the top of the log; and a pair of second substantially inverted V-shaped, longitudinally extending grooves in the bottom of said log on opposite sides of a plane through the vertex of said first groove, the spacing between said second grooves being such that outward extensions of the sides of a first groove in one log would intersect the outer sides of the second grooves of a superjacent log resting on said one log.

According to the second aspect, the invention relates to a wall structure including a plurality of logs of the above described type stacked on top of each other; first insulation substantially filling said first groove of each joint between adjacent logs; and second insulation in said second grooves of each joint between adjacent logs for sealing the outer area of each said first and second grooves.

BRIEF DESCRIPTION OF THE DRAWINGS

The invention will be described in greater detail with reference to the accompanying drawing, which illustrates a preferred embodiment of the invention, and wherein.

DESCRIPTION OF THE PREFERRED EMBODIMENTS

Figure 1:
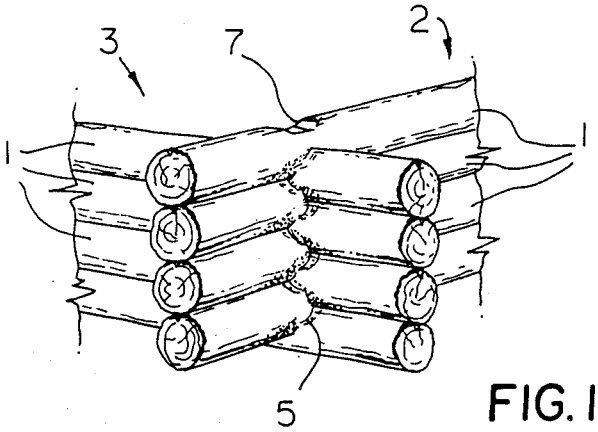
FIG. 1 is a perspective view from above of a portion of one corner of a log building incorporating the log and wall structure of the present invention.
Figure 2:
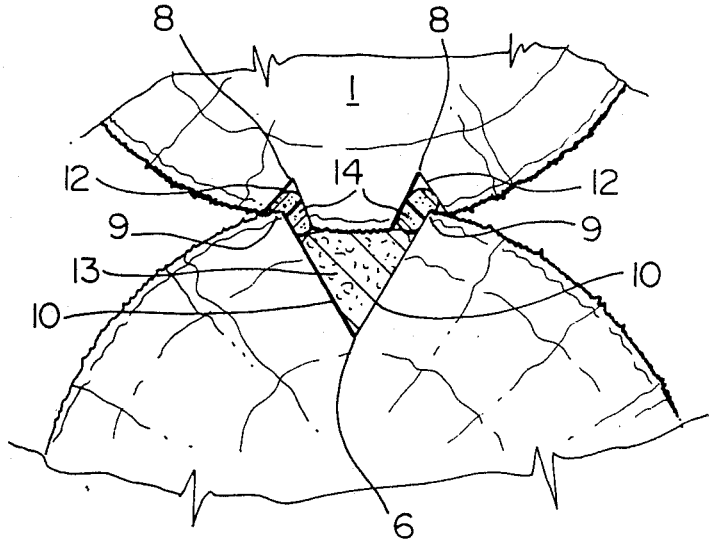
FIG. 2 is a cross-sectional view of portions of two adjacent logs of the structure of FIG. 1.

With reference to the drawing, the building log of the present invention is intended for use in log buildings (not shown) constructed by placing logs 1 on top of each other to form intersecting walls generally indicated at 2 and 3. The logs 1 are notched at intersections or corners 5 so that each of the logs in each wall abuts any subjacent or superjacent log.

The log 1 of this invention solves the problem of sealing the area between adjacent logs in a wall by the provision of a large longitudinally extending, generally V-shaped groove 6 in the top centre of the log. The groove 6 extends the entire length of the log 1, except in the area of the notched corners 5 where the notch 7 intersects the groove.

Smaller, opposing longitudinally extending, inverted V-shaped grooves 8 are provided in the bottom of each log 1. The grooves 8 are located on each side of a plane through the longitudinal axis of the log 1 and through the vertex of the groove 6 in the opposite side of the log. The spacing between the grooves 8 is such that the top corners 9 of the large top groove 6 of one log 1 extend into the grooves 8 of a superjacent log 1 when the logs are placed on top of each other. Thus, if the sides 10 of the groove 6 were extended, they would intersect the outer sides 12 of the grooves 8 of the superjacent log when the logs are in contact.

Two different types of insulation are provided in the joint area, including a loose, glass fibre insulation 13 and more dense insulation 14. The insulation 13 more or less fills the large groove 6, so that the central area of the uppermost log 1 between the grooves 8 bears against such insulation 13. The insulation 14 is a continuous, foam tape, which provides insulation and a vapour barrier or seal along the entire length of the outer areas of the joint between logs.

The use of the logs 1 and insulation 13 and 14 described above results in a tight, waterproof joint between logs. It will be noted that when log 1 rests on another log, the load of the upper or superjacent log is carried by the lower or subjacent log. Moreover, the insulation 13 is not compressed which would adversely affect is insulating quality. The insulation 14, which acts as a seal, is compressed between the outer top edge of the groove 6 and the sides of the groove 8 which enhances the seal between the logs.

What is claimed is:

1. A log for use in constructing a wall by stacking similar logs on top of each other comprising a first longitudinally extending, substantially V-shaped groove in the top of the log; and a pair of second substantially inverted V-shaped, longitudinally extending grooves in the bottom of said log on opposite sides of a plane through the vertex of said first groove, the spacing between said second grooves being such that notional outward extensions of the sides of a first groove in one log would intersect the outer sides of the second grooves of a superjacent log resting on said one log and contact between such logs would be limited substantially to the outer side edge areas of the second grooves and the surface adjacent the sides of the first groove, the bottom of the log between said second grooves being solid and unsplit.

2. A log according to claim 1, wherein said first groove is substantially larger than said second grooves, and said second grooves are substantially equal in size.

3. A wall structure comprising a plurality of logs stacked on top of each other, each said log comprising a first longitudinally extending, substantially V-shaped groove in the top of the log; and a pair of second substantially inverted V-shaped, longitudinally extending grooves in the bottom of said log on opposite sides of a plane through the vertex of said first groove, the spacing between said second grooves being such that notional outward extensions of the sides of a first groove in one log would intersect the outer sides of the second grooves of a superjacent log resting on said one log; first insulation substantially filling said first groove of each joint between adjacent logs; and second, at least partially solid insulation in said second grooves of each joint between adjacent logs and compressed in said second grooves by outer top edges of the first groove for sealing the outer area of each said first and second grooves.

4. A wall structure according to claim 3, wherein said first insulation is relatively less dense insulation, and said second insulation is a relatively more dense sealing insulation.

* * * * *